United States Patent [19]

Boguth

[11] 4,308,924

[45] Jan. 5, 1982

[54] HYDRAULIC VIBRATOR FOR MOVING A RAMMING AND DRAWING BODY AND A METHOD OF MOVING THE SAME

[75] Inventor: Kurt Boguth, Ratingen, Fed. Rep. of Germany

[73] Assignee: Tünkers Maschinenbau GmbH, Ratingen, Fed. Rep. of Germany

[21] Appl. No.: 131,362

[22] Filed: Mar. 18, 1980

[30] Foreign Application Priority Data

May 3, 1979 [DE] Fed. Rep. of Germany ..... 2917830

[51] Int. Cl.[3] ..... B23B 45/16; B25D 9/00; B25D 11/00; B25D 13/00

[52] U.S. Cl. ..... 173/135; 91/39; 173/134

[58] Field of Search ..... 173/134–138, 173/130, 132, 133, 1; 91/39, 40

[56] References Cited

U.S. PATENT DOCUMENTS

| | | | |
|---|---|---|---|
| 2,773,482 | 12/1956 | Dickie | 91/39 X |
| 3,547,206 | 12/1970 | Phillips | 173/134 X |
| 3,805,896 | 4/1974 | Bauer | 91/39 |
| 3,847,230 | 11/1974 | Blomquist | 173/133 X |

*Primary Examiner*—Ronald Feldbaum
*Attorney, Agent, or Firm*—Michael J. Striker

[57] ABSTRACT

A hydraulic vibrator for moving a ramming or drawing body or the like has a hydraulic working cylinder, a double-acting working piston axially movable in the hydraulic working cylinder, and a device for supplying a working medium into the hydraulic working cylinder, alternately at both axial sides of the working piston so that the working piston vibrates with selectively variable frequency and displaces the ramming and drawing body or the like.

14 Claims, 1 Drawing Figure

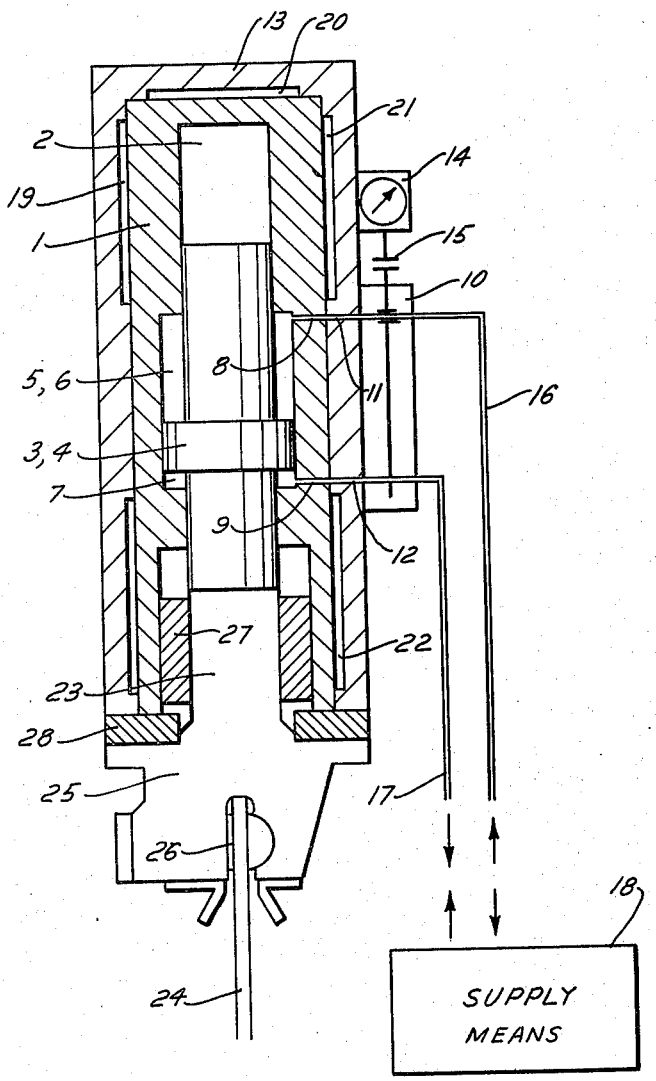
13
20
21
2
14
19
1
15
10
5, 6
8
11
16
3, 4
7
9
12
27
22
23
28
25
17
26
18
24
SUPPLY
MEANS

HYDRAULIC VIBRATOR FOR MOVING A RAMMING AND DRAWING BODY AND A METHOD OF MOVING THE SAME

BACKGROUND OF THE INVENTION

The present invention to a hydraulic pulse vibrator for driving in or drawing out boards, pipes, bulkheads, props or other drivable in or drivable out bodies and a method of moving such bodies.

Vibrating devices which are driven into oscillation by rotatable vibrators are known in underground works, canal construction, dam construction, and other construction fields for driving in or driving out of boards, pipes, bulkheads, props and other drivable in or drivable out bodies. Vibrating devices of the aforementioned general type are disclosed for example in German Offenlegungsschrift No. 2,706,094. In such a device, the obtained oscillations depend, in addition to other factors, on unbalanced mass and number of revolutions of a pair of cooperating vibrators. For many applications it is often not possible to select and utilize the favorable number of revolutions, since the resulting centrifugal force is not sufficient for the existent soil conditions or other operations. Furthermore, it is often necessary or advantageous to perform the oscillations of the vibrating device in completely or substantially invariable manner with constant force. In the known vibrating devices it can be attained only when the number of revolutions of the vibrator remains unchanged. When the number of revolutions of the vibrators is increased or reduced, the centrifugal force which depends on the number of revolutions, quadratically increases or reduces, respectively. The known vibrating devices possess, because of their construction and manner of operation, the further disadvantage in that these devices, by changing the number of revolutions of the vibrators cannot provide at all, or can provide only insufficiently for the force and oscillations which are optimum for the existent soil conditions (soil character, water content and the like). Vibrating devices of this type possess also the disadvantage in that they are considerably limited in their operational possibilities and applicability.

SUMMARY OF THE INVENTION

Accordingly, it is an object of the present invention to provide a hydraulic pulse vibrator which avoids the disadvantages of the prior art.

More particularly, it is an object of the present invention to provide a hydraulic pulse vibrator which is easily and simply adjustable in its functions and power so as to be suitable for actions in different soil conditions or other requirements, and can be utilized for driving in or drawing out pipes, boards, bulkheads, props, beams or other bodies or parts.

It is a further object of the present invention to provide a hydraulic pulse vibrator in which the required oscillations are generated without rotation of unbalanced masses or the like, with the desired constant force, and with selectively variable vibration frequency.

In keeping with these objects and with others which will become apparent hereinafter, one feature of the present invention resides, briefly stated, in a hydraulic pulse vibrator having a working cylinder in which a double-acting working piston moves and which is supplied by a pressure medium alternately at both axial sides of the working piston so that the working piston vibrates with selectively adjustable frequency and serves for displacement of the driving in or drawing out member.

A method of displacing a ramming and drawing body, in accordance with the present invention includes supplying a working medium into the working cylinder alternately at both sides of the working piston, so that the latter vibrates with selectively variable frequency and displaces the ramming and drawing body or the like.

When the hydraulic pulse vibrator is constructed and the method is performed in accordance with the present invention, it is advantageously possible that the working piston is brought directly for driving in or drawing out of the ramming or drawing member, in linear movement with the required or advantageous frequency and amplitude. The working cylinder is supplied with working medium alternately at both sides of the working piston so that during the feeding of the working medium at one side of the working piston, the working medium is simultaneously withdrawn from the other side of the working piston.

The continuous alternative feeding and withdrawing of the pressure medium imparts to the working piston continuous vibratory movement. The frequency of the working piston depends on the frequency of the feeding of the pressure medium. When the frequency of the feeding increases, the frequency of the vibratory movement of the working piston necessarily correspondingly increases. When the feeding frequency reduces, the vibratory movements of the working piston are performed with a lower frequency. Thereby, by selective varying of the feeding frequency of the pressure medium the working piston automatically vibrates with the desired varied frequency. It is especially advantageous that when the frequency is varied, no variation of the pressure force of the working piston takes place. The working piston can vibrate and operate with unchanged constant pulse force with properly selected frequency.

Since the drivable in or drawable out members subjected to the action of the vibrating working piston are different in their position, it is generally required to maintain a predetermined distance to the working piston and working cylinder. These or other desirable distance variations of the drivable in and drawable out members can be adjusted in a simple and advantageous manner by respective greater displacement of the working piston in one direction. In accordance with another feature of the present invention, the working cylinder is supplied with different quantities of the pressure medium at both sides of the working piston so that the latter is displaced farther in one direction. By augmented feeding of the pressure medium at one side of the working piston, the cylinder of the working piston in the respective desirable direction can be increased. It is not necessary for this purpose to displace the arrangement as a whole.

In accordance with still another feature of the present invention the pulse force of the working piston is transmitted through intermediate means such as a striking element, an intermediate element or the like, in force-locking manner to the fixedly connectable drivable in or drawable out member. Such an arrangement is economical and very simple.

In accordance with a further feature of the present invention, the feeding and withdrawal of the pressure medium is performed by a pulse generator which is driven by an electric motor. An electric motor, a hydraulic motor or another suitable arrangement can be utilized for driving the pulse generator which latter displaces the pressure medium in desired quantity and with desired frequency to the working cylinder with the working piston or from the latter.

The feeding and withdrawal of the pressure medium thereby depends on the number of revolutions of the pulse generator. The number of revolutions of the pulse generator depends, in turn, on the number of revolutions of the drive motor, whereby the frequency of the working piston can be varied as a result of the variations of the number of revolutions of the drive motor. The variations of the number of revolutions of the drive motor can be performed in stepless manner so that each desirable frequency can be steplessly obtained. Such a frequency adjustment is especially important and desirable and is very advantageous when, for example, for driving in great oscillation amplitudes are required which can be attained by simple and easy adjustment of the number of revolutions of the drive motor with respect to the samller number of revolutions. Contrary to this, it is possible to attain by varying of the number of revolutions higher required frequencies for selectively smaller oscillation amplitudes, which, for example, are especially suitable and advantageous for concrete compression.

The intermediate means such as the striking element for performing the afore-mentioned functions may have a simple cylindrical or other suitable shape. It can be constructed and arranged in such a manner that it loosely abuts against the driving in or drawing out member, or fixedly connected with the same. Advantageously, the striking element is provided with a formation which serves as a clamping arrangement for the driving in or the drawing out member. An elastic or other suitable bearing member may be provided in the working cylinder for axially and radially guiding the striking element.

In accordance with a further feature of the present invention, the working cylinder with the working piston is provided with a casing of steel or other material, which serves for protecting the working cylinder and the working piston from damages and dirtying, and reduction of noise or vibrations of the same. This casing is advantageously constituted of steel and has a sufficient weight in order to serve as a surcharge. Such a surcharge is, for example, necessary or desirable in the cases when, for special applications, a greater weight of the arrangement is required in order to compensate for the generated counter-pressure.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing is a view showing a hydraulic pulse vibrator in accordance with the present invention.

DESCRIPTION OF A PREFERRED EMBODIMENT

A pulse vibrator in accordance with the present invention has a hydraulic working cylinder 1 forming a cylinder chamber 2 in which a double-acting working piston 3 moves in an axial direction. The working piston 3 is provided in its central region with a ring-shaped raised portion 4 which is located in a ring-shaped chamber 5 of the working cylinder 1 and axially moves together with the working piston 3.

By the ring-shaped raised portion 4 of the working piston 3, the ring-shaped chamber 5 is subdivided into an upper working chamber 6 and a lower working chamber 7 for a pressure medium. Both working chambers 6 and 7 are sealed from one another. In order to supply the pressure medium to and withdraw the same from the working cylinder 1 the latter is provided with an opening 8 communicating with the working chamber 6 and an opening 9 communicating with the working chamber 7.

The required supply of the working medium to the working chambers 6 and 7 are performed by a pulse generator 10. The working chamber 6 communicates with the pulse generator 10 via a conduit 11 whereas the working chamber 7 communicates with the same via a conduit 12. The pulse generator 10 is selected and constructed so as to alternatively supply the pressure medium to the working chambers 6 and 7 in predetermined quantity and sequence, whereby during the feeding of the pressure medium in one of the working chambers the withdrawal of the pressure medium from the other of the working chambers is simultaneously performed. As a result of this, the working piston 3 is alternately subjected to the action of the pressure medium at both sides of its ring-shaped raised portion 4 and gradually displaces in opposite axial directions. The working piston 3 performs its predetermined vibratory movement.

The vibratory movement depends on the number of revolutions of the pulse generator 10. The number of revolutions of the pulse generator 10 depends, in turn, on the selectively and steplessly controllable number of revolutions of a drive motor 14. Thereby the desirable frequency of the vibratory movement of the working piston 3 can be attained in easy and simple manner by varying the number of revolutions of the drive motor 13. Furthermore, it is possible to selectively feed to or withdraw from the working chambers 6 and 7 equal quantities of the pressure medium, so that the working piston 3 performs one-sided greater vibratory movement and thereby displaces in the respective direction.

The drive motor 14 for the impulse generator 10 is a steplessly adjustable motor and can be arranged on the working cylinder 1 or on a casing 13 which will be described in more detail hereinbelow. An electric, hydraulic or other motor can be utilized as a drive motor for the pulse generator 10. A coupling 15 may be provided between the drive motor 14 and the pulse generator 10. The conduits 11 and 12 lead from the pulse generator 10 to the working chambers 6 and 7, on the one hand, and conduits 16 and 17 lead from a supply aggregate, tank or the like 18 to the pulse generator 10, on the other hand. Each of the above-mentioned four conduits 11, 12, 16 and 17 serves for feeding or withdrawal of the pressure medium.

The casing 13 can be detachably or undetachably mounted on the working cylinder 1 so as to enclose the latter. The casing 13 can be formed as a one-part or multipart element constituted of steel or other material. Advantageously the casing 13 is provided with recesses on its inner surface which serve for reduction of noise or vibrations or for other purposes. The recess form between the casing 13 and the working cylinder 1, ring-shaped or similar intermediate chambers 19–22. The intermediate chambers can be provided with liquid or solid sound-reducing or vibration-reducing means, in dependence upon the respective requirements.

An intermediate element such as a striker, an intermediate member or the like 23, is located at the lower end of the working piston 3. The element 23 is provided for receiving and force-lockingly transmitting the vibrations of the working piston 3 to a driving in or drawing out member 24. The striking element can abut against the end of the working piston 3 loosely. On the other hand, the above-mentioned parts may be fixedly connected with one another so as to provide for favorable operation and efficiency. The striking element 23 may have a simple cylindrical or other suitable shape. It may be so formed and arranged that it loosely abuts against the driving in or drawing out member 24 or is fixedly connected with the latter. The striking element 24 can be provided with a clamping arrangement 25 so as to form a unitary structure. The driving in and drawing out member 24 can be force-lockingly retained in the clamping arrangement 25 by means of clamping jaws or other parts 26.

A bearing member 27 of elastic material serves for axial and radial guidance of the striking element 23 in the working cylinder. An elastic spacing ring or the like member 28 is further provided. The member 28 serves as a closure or a seal for the working cylinder 1 and the casing 13.

It will be understood that each of the elements described above, or two or more together, may also find a useful application in other types of constructions differing from the types described above.

While the invention has been illustrated and described as embodied in a hydraulic pulse vibrator, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A hydraulic vibrator for moving a ramming and drawing body or the like, comprising a hydraulic working cylinder having an axis and an inner hollow; a double-acting working piston axially movable in said inner hollow of said hydraulic working cylinder, said working piston having two opposite axial end portions and subdividing said inner hollow of said cylinder into two cylinder chambers, said axial end portions of said piston having identical outer diameters and each extending into a respective one of said cylinder chambers, said cylinder chambers having identical inner diameters and being each provided with a through-going opening; and means for alternately supplying a working medium into said hydraulic working cylinder, alternately through said through-going openings into said cylinder chambers with feeding the working medium into one of said cylinder chambers and simultaneous withdrawal of the working medium from the other of said cylinder chambers, and vice versa, so that said working piston vibrates with selectively variable frequency and displaces a ramming and drawing body or the like.

2. A hydraulic vibrator as defined in claim 1, wherein said supplying means is arranged to generate in said working piston a pulse force which does not vary in dependence upon the variations of frequency of the vibrations of said working piston.

3. A hydraulic vibrator as defined in claim 1, wherein said means is arranged to supply into said cylinder chambers different quantities of the pressure medium so that said working piston is gradually displaced in one direction.

4. A hydraulic vibrator as defined in claim 1, wherein said means is arranged to generate in said working piston a pulse force; and further comprising an intermediate member arranged to force-lockingly transmit the pulse force of said working piston to the ramming and drawing body.

5. A hydraulic vibrator as defined in claim 4, wherein said intermediate member is a striking element.

6. A hydraulic vibrator as defined in claim 1, wherein said means includes a pulse generator and a motor driving said pulse generator.

7. A hydraulic vibrator as defined in claim 6, wherein said motor has an adjustable number of revolutions and is arranged to vary the frequency of said working piston in dependence upon adjusting the number of revolutions of the former.

8. A hydraulic vibrator as defined in claim 4; and further comprising means for connecting said intermediate member with the ramming and drawing body.

9. A hydraulic vibrator as defined in claim 8, wherein said connecting means is a clamping device provided on said intermediate member.

10. A hydraulic vibrator as defined in claim 4; and further comprising elastic means for axially and radially guiding said intermediate member in said hydraulic working cylinder.

11. A hydraulic vibrator as defined in claim 10, wherein said elastic guiding means includes an elastic bearing member located between said hydraulic working cylinder and said intermediate member.

12. A hydraulic vibrator as defined in claim 11; and further comprising a casing which encloses said hydraulic working cylinder and serves as a surcharge.

13. A hydraulic vibrator as defined in claim 12, wherein said casing is provided with noise-reducing means.

14. A hydraulic vibrator as defined in claim 1, wherein said working piston has a central raised portion subdividing said inner hollow of said cylinder into said two cylinder chambers, said end portions of said working piston extending from said central portion in two opposite axial directions.

* * * * *